US008022611B2

(12) United States Patent
Yamazaki

(10) Patent No.: US 8,022,611 B2
(45) Date of Patent: Sep. 20, 2011

(54) LIGHT EMITTER SUBSTRATE AND IMAGE DISPLAYING APPARATUS USING LIGHT EMITTER SUBSTRATE

(75) Inventor: Koji Yamazaki, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 12/511,519

(22) Filed: Jul. 29, 2009

(65) Prior Publication Data

US 2010/0033076 A1 Feb. 11, 2010

(30) Foreign Application Priority Data

Aug. 11, 2008 (JP) ..... 2008-206568
Jul. 13, 2009 (JP) ..... 2009-164467

(51) Int. Cl.
*H01J 1/62* (2006.01)

(52) U.S. Cl. ..... 313/495; 313/292; 313/496; 313/497

(58) Field of Classification Search ..... 313/292, 313/495–497
See application file for complete search history.

(56) References Cited

U.S. PATENT DOCUMENTS

| | | | | |
|---|---|---|---|---|
| 6,509,691 | B2 | 1/2003 | Yamazaki et al. | |
| 6,853,148 | B2 | 2/2005 | Yamazaki et al. | |
| 6,946,786 | B2 * | 9/2005 | Ando | 313/496 |
| 7,053,537 | B2 | 5/2006 | Hiroike et al. | |
| 7,247,981 | B2 | 7/2007 | Yamazaki | |
| 7,391,149 | B2 | 6/2008 | Yamazaki | |
| 7,400,082 | B2 | 7/2008 | Suzuki et al. | |
| 7,537,503 | B2 | 5/2009 | Hiroike et al. | |
| 2005/0162065 | A1 * | 7/2005 | Kojima et al. | 313/495 |
| 2007/0126339 | A1 | 6/2007 | Kato et al. | 313/496 |
| 2007/0200474 | A1 | 8/2007 | Onishi | 313/292 |
| 2009/0160313 | A1 | 6/2009 | Yamazaki et al. | |
| 2009/0302735 | A1 | 12/2009 | Yamazaki et al. | |
| 2010/0001630 | A1 | 1/2010 | Yamazaki | |

FOREIGN PATENT DOCUMENTS

| | | | |
|---|---|---|---|
| EP | 1 624 476 | A1 | 2/2006 |
| JP | 2004-158232 | A | 6/2004 |
| JP | 2006-92878 | A | 4/2006 |
| JP | 2007-134084 | | 5/2007 |
| WO | WO 94/18694 | | 8/1994 |

OTHER PUBLICATIONS

European Search Report issued in the counterpart application No. 09166723.8 dated Jun. 24, 2010—8 pages.

* cited by examiner

*Primary Examiner* — Nimeshkumar D Patel
*Assistant Examiner* — Mary Ellen Bowman
(74) *Attorney, Agent, or Firm* — Fitzpatrick, Cella, Harper & Scinto

(57) ABSTRACT

There is provided a light emitter substrate which can suppress halation by forming a rib between adjacent light-emitting members of respectively different light emitting colors, and at the same time can withdraw a potential difference when a discharge occurs between adjacent metal backs, thereby achieving a desired discharging current suppressing capability. For that purpose, the plural parallel ribs protruding from a substrate are formed, a phosphor is provided between the adjacent ribs, plural divided metal backs are disposed respectively on the phosphors in the direction along the ribs, the metal back is connected to a feeding resistor on the rib by means of a connection conductor, and the feeding resistor is covered by a high-resistance cover member.

6 Claims, 8 Drawing Sheets

LIGHT EMITTER SUBSTRATE AND IMAGE DISPLAYING APPARATUS USING LIGHT EMITTER SUBSTRATE

BACKGROUND OF THE INVENTION

1. Field of the Invention

The present invention relates to a light emitter substrate which is applied to a face plate of an electron-beam displaying apparatus, and an image displaying apparatus which is constituted by using the light emitter substrate.

2. Description of the Related Art

An electron-beam displaying apparatus includes an electron source and a light emitter substrate which emits light in response to electrons from the electron source. In particular, it is hoped for a displaying apparatus which uses a combination of electron-emitting devices and phosphors to have an excellent characteristic as compared with conventional displaying apparatuses of other kinds. For example, since the displaying apparatus which uses the combination of the electron-emitting devices and the phosphors is a self-emitting type unlike recently popularized liquid crystal displaying apparatuses, any back light is unnecessary, a field angle is wider that that of the liquid crystal display, and a faster-moving video can be displayed as compared with the liquid crystal display. That is, the displaying apparatus which uses the combination of the electron-emitting devices and the phosphors is excellent in these points.

In the displaying apparatus like this in which the electron-emitting devices are used, an electron source substrate having the plural electron-emitting devices and a light emitter substrate having light-emitting members and a metal back are arranged opposite to each other. On such a premise, it is necessary to provide a means for preventing optical crosstalk (halation) that electrons which once entered the light-emitting devices are discharged from the light-emitting devices and then the discharged electrons enter the light-emitting members at other positions. As the means like this, Japanese Patent Application Laid-Open No. 2004-158232 discloses a constitution that ribs are provided on a light emitter substrate.

Moreover, Japanese Patent Application Laid-Open No. 2006-092878 discloses a constitution that damage due to a discharge is reduced by dividing a metal back into electrically small areas and the divided metal backs are wholly stabilized by providing a rib between the adjacent metal backs.

In the constitutions respectively disclosed in Japanese Patent Application Laid-Open Nos. 2004-158232 and 2006-092878, a problem of halation is solved because the ribs are provided. However, also a constitution capable of withdrawing a potential difference between the adjacent metal backs is needed in a case where potential of the metal back is increased or a case where resolution of a display is made further higher.

SUMMARY OF THE INVENTION

The present invention aims to provide a light emitter substrate which can suppress halation by forming a rib between adjacent light-emitting members of respectively different light emitting colors, and at the same time can withdraw a potential difference when a discharge occurs between adjacent metal backs, thereby achieving a desired discharging current suppressing capability. Moreover, the present invention aims to provide an image displaying apparatus which uses the light emitter substrate, thereby achieving a high contrast and high withstand discharge performance.

A first aspect of the present invention is characterized by a light emitter substrate which comprises: a substrate; plural light-emitting members positioned in matrix on the substrate; a rib positioned between the light-emitting members and protruding from the substrate as compared with the light-emitting member; plural conductors each covering at least one of the light-emitting members and mutually positioned in matrix at gaps; and a feeding resistor configured to electrically connect the plural conductors, wherein the feeding resistor is positioned on the rib, and a high-resistance cover member which covers the feeding resistor and of which resistance is higher than that of the feeding resistor is provided on the feeding resistor.

The first aspect of the present invention includes the following constitution as a preferred aspect.

The cover member wholly covers the feeding resistor.

A second aspect of the present invention is characterized by an image displaying apparatus wherein an electron source substrate which is equipped with plural electron-emitting devices and the light emitter substrate which is described as the above first aspect of the present invention are mutually positioned oppositely. The second aspect of the present invention includes as a preferred aspect the constitution that a spacer is positioned between the electron source substrate and the light emitter substrate, and resistance of the cover member of the light emitter substrate is lower than resistance of the spacer.

In the light emitter substrate according to the present invention, since the metal back are divided into the plural metal backs, the discharging current at the time of the discharge can be suppressed. Further, since the rib is provided, halation can be suppressed, whereby an image of which the color reproducibility is excellent can be displayed. Furthermore, since the feeding resistor on the rib is covered with the high-resistance cover member, a secondary discharge can be suppressed. Therefore, in the image displaying apparatus which uses the light emitter substrate according to the present invention, since the contrast is high and the withstand discharge performance is high, a high-quality image can stably be displayed.

Further features of the present invention will become apparent from the following description of the exemplary embodiments with reference to the attached drawings.

DESCRIPTION OF THE EMBODIMENTS

Hereinafter, the exemplary embodiments of the present invention will be described.

A light emitter substrate of the present invention can be applied to a face plate for an electron beam displaying apparatus, for example, a field emission display (FED) and a cathode ray tube (CRT). Especially, in the FED, a beam diameter can be easily narrowed down and color reproducibility is excellently improved by suppressing the halation. Additionally, in the FED, since a space between an anode and a cathode becomes a high-field state, even if the discharge phenomenon occurred, such withstand discharge performance of not deteriorating the image displaying capability is required. Therefore, the light emitter substrate of the present invention is preferably applied as a face plate.

Regarding the embodiments of the present invention, especially, an image displaying apparatus of using surface conduction electron-emitting devices is exemplified among FEDs, and the description will be specifically given by using the drawings.

Figure 1A:
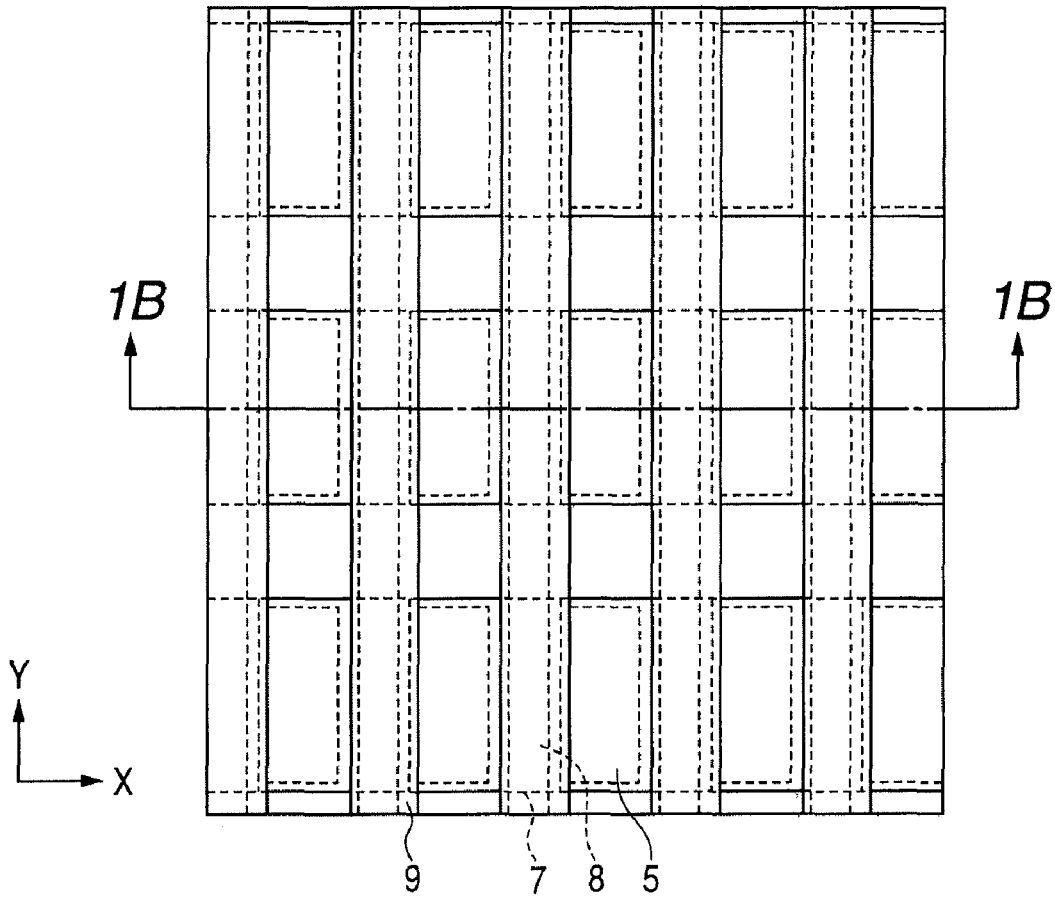
FIGS. 1A and 1B are views schematically illustrating the constitution of a light emitter substrate according to the embodiment of the present invention.
Figure 1B:
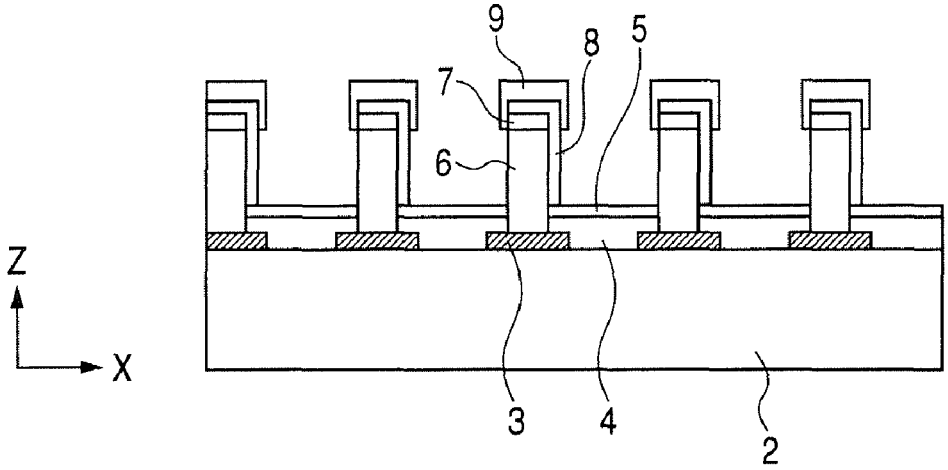

FIG. 1A is a schematic plan view illustrating an inner face of the light emitter substrate according to the embodiment of the present invention, and FIG. 1B is a schematic cross-sectional view along a line 1B-1B in FIG. 1A. Hereinafter, the constitution will be mentioned.

In FIGS. 1A and 1B, it is preferable that a substrate 2 is a glass substrate especially in a point of maintaining vacuum property and the intensity. In addition, there are illustrated a black member 3, a phosphor 4 serving as a light-emitting member, a metal back 5 (anode electrode) serving as a conductor and a rib 6. In FIGS. 1A and 1B, the X direction is a second direction according to the present invention and the Y direction orthogonal to the X direction is a first direction.

Figure 2:
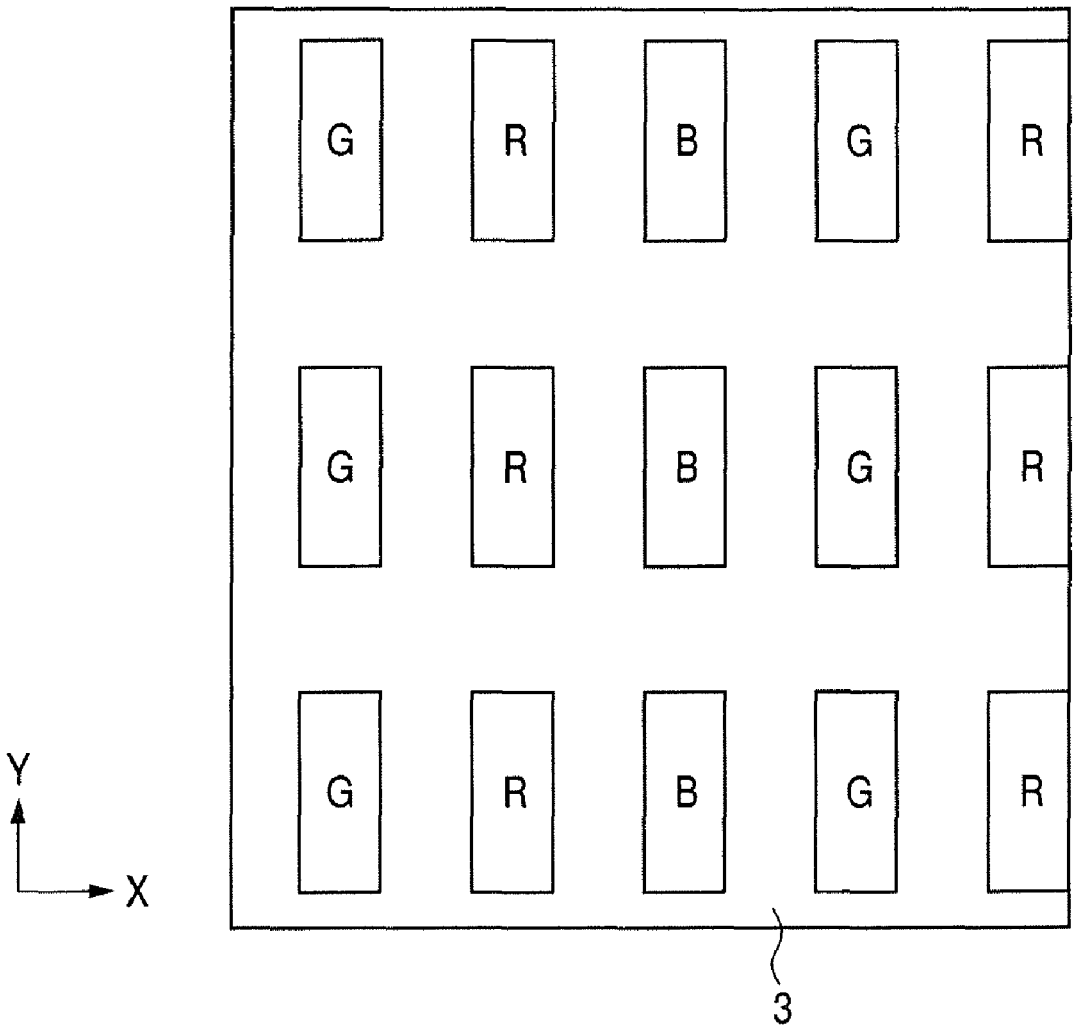
FIG. 2 is a schematic plan view illustrating the constitution of a black member used in the light emitter substrate illustrated in FIGS. 1A and 1B.

The black member 3 has aperture portions to be formed in a lattice shape (black matrix). The phosphors 4 are formed in the aperture portions and color-coded in R, G and B in case of a color display. A color coding pattern can be arbitrarily determined in accordance with display characteristics and is not especially limited. FIG. 2 is a plan view of the black member illustrated in FIGS. 1A and 1B, and the phosphors 4 are color-coded in matrix (in FIG. 2, a color coding pattern is illustrated by colors of R, G and B) in the black member formed in a lattice shape.

In the present invention, the plural ribs 6, which protrude from a surface of the substrate 2, are arranged in parallel at least in the one direction to suppress the halation. In the present embodiment, the ribs 6 extending in the Y direction are formed on the black member 3, and the height of the ribs 6 is arbitrarily selected according to a pixel size or the anode voltage. The phosphors 4 are arranged in matrix between the adjacent ribs.

The metal back 5 serving as a conductor improves the luminance by specularly reflecting the light, which is emitted to an inner face side among the light emitted from the phosphor 4, to a side of the substrate 2 and actions as an anode electrode used for applying the electron beam acceleration voltage. In the present invention, the metal back 5 serving as a conductor is divided into plural sections in the direction parallel to the ribs 6 to be arranged on the phosphors 4 in order to suppress a discharge current when the discharge phenomenon occurred. In the present embodiment, the respective sections are formed in matrix on the phosphors 4 so as to cover the aperture portions provided in the black member 3. Hereinafter, the metal back 5 serving as a conductor is simply expressed as the metal back 5, and the description will be given.

A feeding resistor 7 used for supplying the anode potential is formed on the rib 6, and a connecting conductor 8 for electrically connecting the metal back 5, which is arranged along the rib 6 on which the feeding resistor 7 is formed, with the feeding resistor 7 is arranged on the side surface of the rib 6. Incidentally, if the metal back 5 is prolonged up to the side surface of the rib 6, it is possible to substitute the metal back for the connecting conductor 8. Further, if the high-resistance rib 6 is used, it is possible to omit providing the connecting conductor 8 itself.

Additionally, in the present invention, a cover member 9 is formed so as to cover at least an area along the metal back 5 on the feeding resistor. In the present embodiment, since the connecting conductor 8 covers the area on the feeding resistor 7, the cover member 9 is formed so as to cover the connecting conductor 8, and additionally, the cover members 9 are sequentially formed on also the feeding resistors 7 between areas adjacent to each other in the Y direction.

The cover member 9 is formed by the material of which the resistance is higher than that of the feeding resistor 7. When the discharge phenomenon occurred, potential difference is generated between the adjacent feeding resistors 7, and in a case that the anode potential is increased or the display resolution is set to become a more high-definition display, the field intensity between the adjacent feeding resistors 7 becomes a high intensity, and there is possibility of occurring secondary discharge. The secondary discharge can be suppressed by covering the feeding resistor 7 by such the cover member 9, and a desired discharge current suppressing function can be obtained. As an effect of suppressing the discharge, although it is allowed that at least an area along the metal back 5 adjacent to the feeding resistor 7 is covered on the feeding resistor, preferably, a whole of the feeding resistor 7 should be covered also including a matter of convenience on a manufacturing process.

Note that the ribs 6 can be formed by the known processing method such as a method of laminating the pattern printings, a method of blasting a thick film or a slit coating method. Among these methods, a blasting process is preferable from a viewpoint of productivity, accuracy or a matter of coping with a large screen. It is preferable that volume resistance of the rib 6 is equal to or larger than 100 Ω·m.

Also, the feeding resistors 7 or the cover members 9 can be formed by the known method such as a pattern printing method or a dispenser method. Among these methods, the pattern printing method is preferable from a viewpoint of accuracy or productivity. As the feeding resistors 7, it is preferable that volume resistance thereof is in a range from 0.01 Ω·m to 10 Ω·m. As the cover members 9, it is preferable that volume resistance thereof is equal to or larger than 100 Ω·m.

The ribs 6, the feeding resistors 7 and the cover members 9 can be respectively formed by printing the commercially-produced paste material and performing the patterning in accordance with necessity and then performing the baking.

Additionally, the metal back 5 or the connecting conductor 8 can be patterned by performing the masking or the etching in the known deposition method. Among these processes, a mask vapor deposition method is preferable. The metal back 5 and the connecting conductor 8 may be simultaneously formed or separately formed. As the material, aluminum, titanium or chrome is used.

Figure 3:
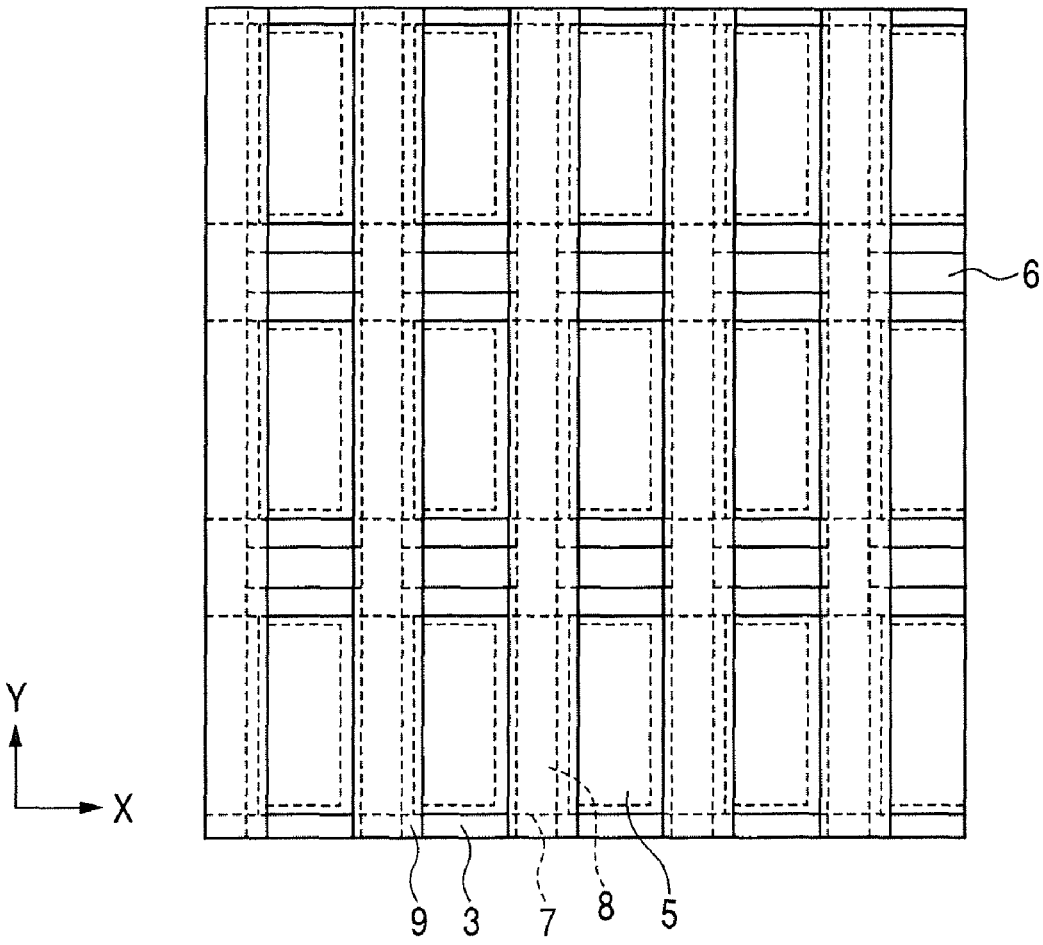
FIG. 3 is a view schematically illustrating the constitution of another embodiment of a light emitter substrate in the present invention.

In an example illustrated in FIGS. 1A and 1B, although the ribs 6 were formed parallel to the Y direction, the plural ribs are formed in parallel also in the X direction in the present invention, and it is also possible to form a lattice shape as illustrated in FIG. 3. According to this constitution, the halation can be suppressed in the two-dimensional directions, and this effect is preferable.

In an example illustrated in FIGS. 1A and 1B, the feeding resistors 7 are formed on all the ribs 6, and the metal backs 5 arranged along the side surfaces of the one side of the ribs 6 are connected to the feeding resistors 7. However, the present invention is not limited to this constitution.

In the present invention, the plural metal backs 5 may form the anode area electrically connected by the connecting conductors 8 formed stepping over the ribs 6, in the X direction. In this case, the feeding resistors 7 may be arranged such that at least one line feeding resistor is electrically connected to one anode area. That is, if at least the one line feeding resistor 7 is connected within the one anode area, the feeding resistors 7 are not required to be formed on all the ribs 6 positioned within the anode area, and the number of the feeding resistors 7 can be thinned out.

For example, in case of forming an anode area by electrically connecting the three metal backs 5 in the X direction, the number of ribs 6 passing through the anode area becomes two, and if the feeding resistor 7 is formed on the one rib 6, the feeding resistors 7 may be formed or not formed on the other ribs 6. However, it is preferable that the cover members 9 are formed on also the ribs 6 on which the feeding resistors 7 are not formed. That is, in case of arranging a spacer, if only the cover members on the feeding resistors protrude, there is the possibility of occurring the breaking of the respective members due to the concentration of stress in some cases. However, this situation can be prevented.

Although the feeding resistor 7 is not required to be formed on the rib 6 positioned between adjacent anode areas, shapes of the feeding resistors are sometimes varied, therefore it is preferable that the cover members 9 are formed on the ribs 6 in order to hide an unpredictable electrical field concentration part.

Figure 4A:
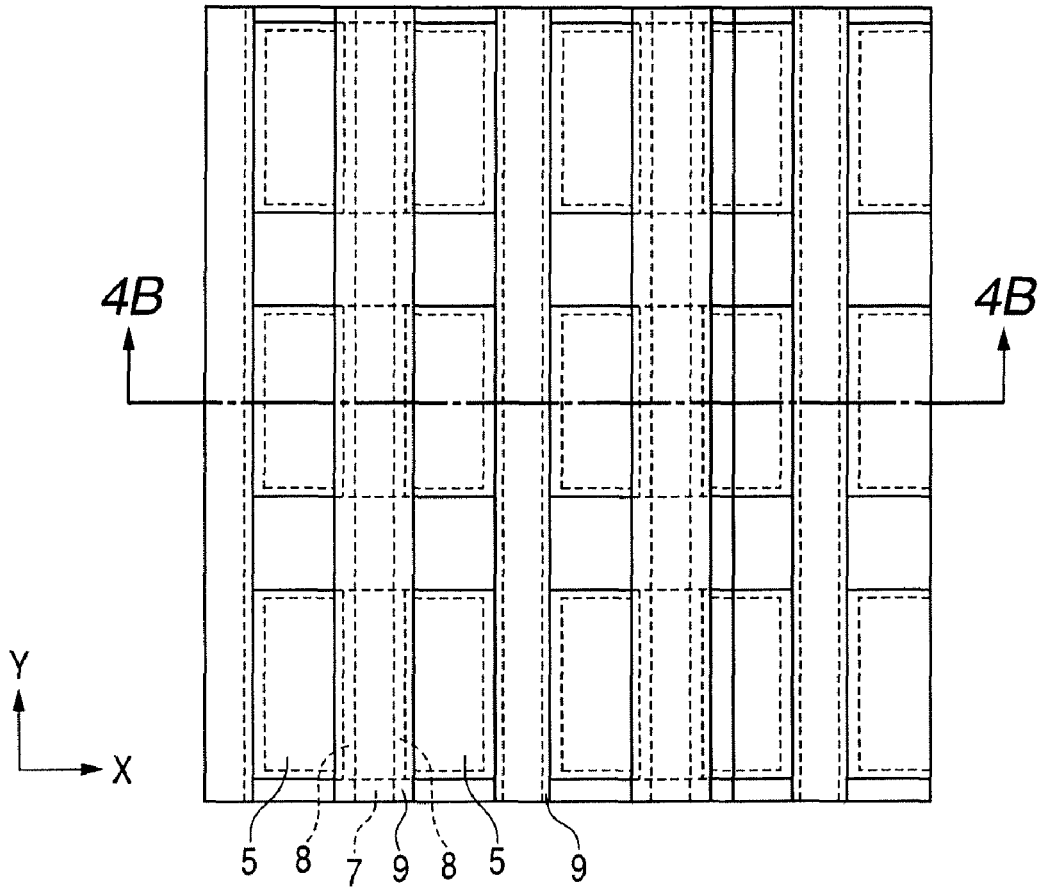
FIGS. 4A and 4B are views schematically illustrating the constitution of another embodiment of a light emitter substrate in the present invention.
Figure 4B:
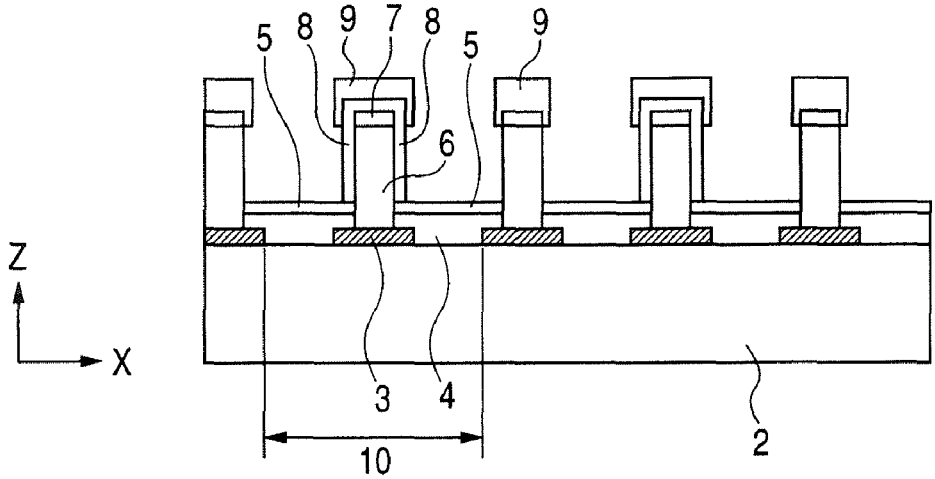

For example, as illustrated in FIGS. 4A and 4B, the two metal backs 5 are electrically connected with the feeding resistor 7 formed on the rib 6 positioned between these metal backs 5 in the X direction by the connecting conductor 8 formed stepping over the rib 6, and one anode area 10 can be formed.

In such the constitution, since the distance between the adjacent feeding resistors 7 is extended as compared with the constitution illustrated in FIGS. 1A and 1B, the field intensity can be further weakened, and the secondary discharge can be effectively prevented. This constitution becomes an effective means of keeping the withstand discharge performance to a desired condition depending on the anode voltage or a pixel size.

In the constitution illustrated in FIGS. 4A and 4B, the metal backs 5 connected with both sides of the one feeding resistor 7 become one anode area. In this constitution, edge portions of the anode area are positioned on root portions of the ribs 6, and the rib 6 is arranged between the adjacent anode areas. As a result, the creepage distance for insulation between the adjacent anode areas can be lengthened and edge portions of the adjacent anode areas are not observable each other (blocked off by the rib 6). Accordingly, the secondary discharge between the adjacent anode areas can be prevented.

Figure 5:
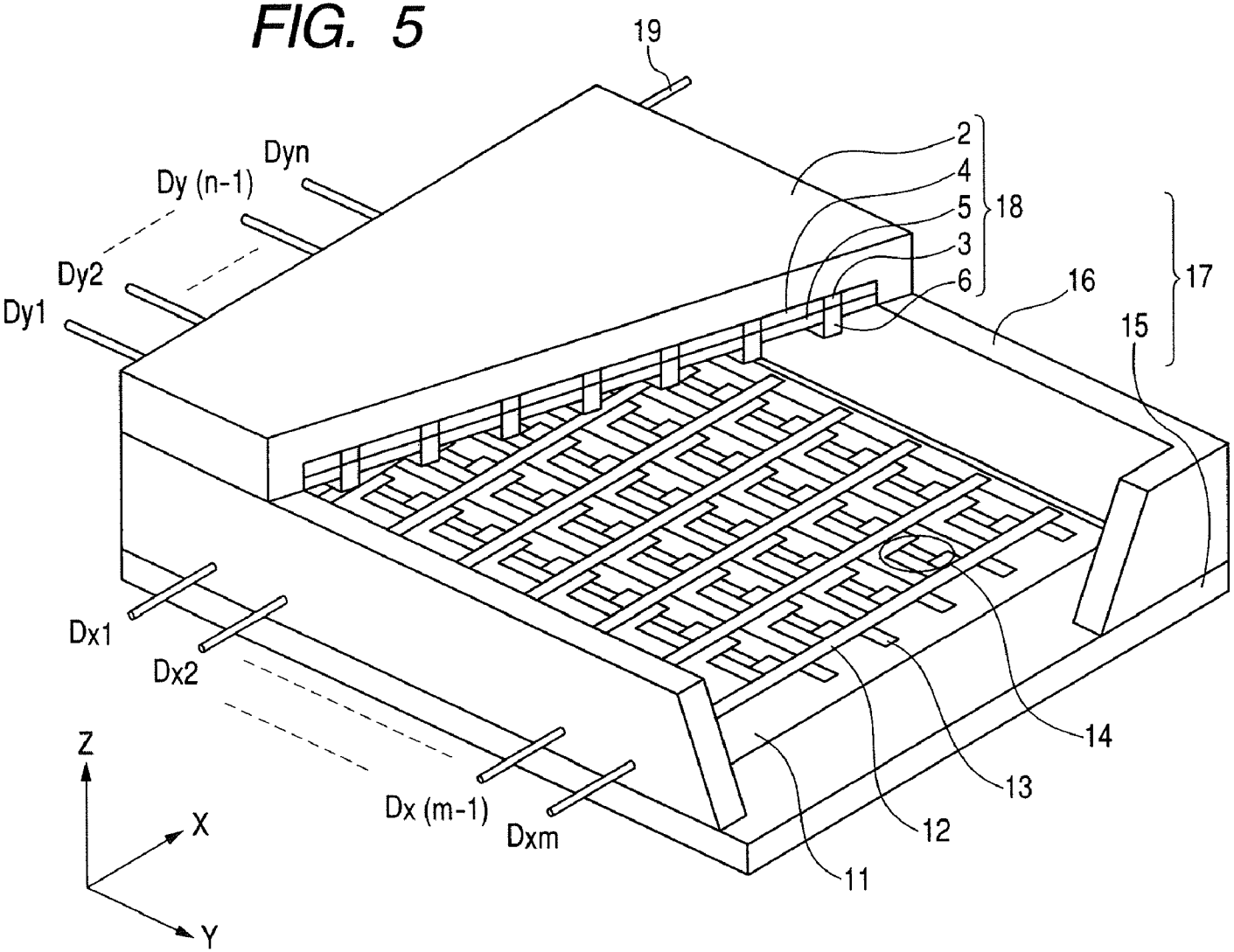
FIG. 5 is a perspective view schematically illustrating the constitution of a display panel of an embodiment of an image displaying apparatus in the present invention.

Next, an image displaying apparatus of using a light emitter substrate of the present invention will be described. FIG. 5 is a schematic view illustrating an example of a display panel of the image displaying apparatus, which uses the light emitter substrate exemplified in FIGS. 1A and 1B as a face plate, and is a partial fractured perspective view. In FIG. 5, the same members as those in FIGS. 1A and 1B are denoted by the same reference numerals and the description thereof will be omitted. In FIG. 5, some members such as the feeding resistors 7, the connecting conductors 8 and the cover members 9 are omitted for the sake of convenience.

In FIG. 5, a face plate 18, which serves as the light emitter substrate exemplified in FIGS. 1A and 1B, is illustrated. In addition, an electron source substrate 11, X-directional wirings 12, Y-directional wirings 13 and surface conduction electron-emitting devices 14 are mounted on a rear plate 15. There are provided m lines of the X-directional wirings 12 and n lines of the Y-directional wirings 13, and the devices 14 of m×n pieces are formed. Here, m and n, which are positive integers, are arbitrarily set in accordance with the intended number of display pixels. For example, in case of a FHD (full high definition) display, the line number of m is equal to 1080 and the line number of n is equal to 1920×3, that is, equal to 5760.

In FIG. 5, a support frame 16 forms a vacuum envelope 17 together with the face plate 18 and the rear plate 15. The image displaying apparatus is formed by adding a power supply, a driver circuit and the like not illustrated in FIG. 5 to the vacuum envelope 17. When it is simply described, the metal back 5 is electrically connected with an Hv terminal 19 of the vacuum envelope 17 and the high voltage about 1 kV to 15 kV is applied by a high-voltage power supply. The X-directional wirings 12 and the Y-directional wirings 13 are respectively connected to terminals Dx1 to Dxm and terminals Dy1 to Dyn of the vacuum envelope 17, and scanning signals and image signals are respectively given by the driver circuit. The electron-emitting devices 14 emit electrons which correspond to signals, and the emitted electrons are attracted by the potential of the metal back 5 and pass through the metal back 5 to make the phosphor 4 emits the light. The luminance can be adjusted by the above-mentioned high voltage and signals. Some parts of the electrons are spread reflected and further some parts of the reflected electrons make the phosphor to emit the light again, and so-called the halation is caused. Consequently, if the light emitter substrate of the present invention is used as the face plate 18, the halation can be suppressed, and an image displaying apparatus excellent in a withstand discharge function can be provided.

Figure 6:
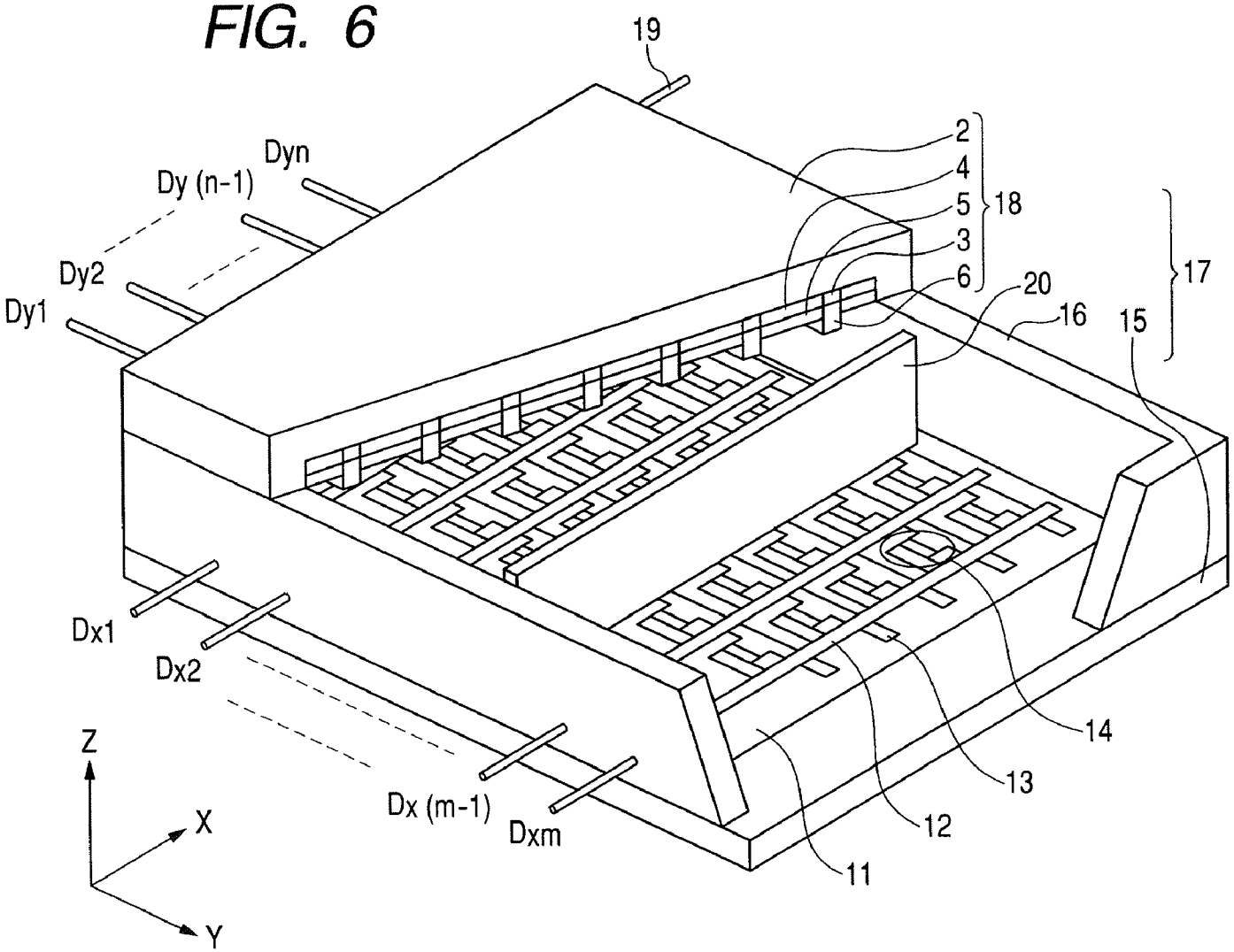
FIG. 6 is a perspective view schematically illustrating the constitution of a display panel of another embodiment of the image displaying apparatus in the present invention.

In a case that a size of the image displaying apparatus becomes a large size, a spacer 20 used as a withstand atmospheric pressure may be arranged within the panel as illustrated in FIG. 6. In this case, in order to prevent to charge the spacer, it is desirable that the spacer 20 is a high-resistance member through which a micro amount of current flows. In addition, since the spacer 20 becomes to abut against the cover members 9 of the light emitter substrate, it is required that the resistance in the film thickness direction (Z direction) of the cover members 9 is sufficiently lower as compared with the resistance in the height direction (Z direction) of the spacer 20. Preferably, the resistance of the cover members 9 is equal to or less than 1/100 of the resistance of the spacer 20. According to this constitution, the potential of the spacer 20 can be defined at a preferable level.

EXAMPLES

Example 1

The light emitter substrate illustrated in FIGS. 1A and 1B was manufactured. A manufacturing process will be described by using FIGS. 7A and 7B and FIGS. 8A and 8B.

A lattice form, which has aperture portions on only desired areas within a light-emitting area, was screen printed on a surface of a cleaned glass substrate 2 by using a black paste (NP-7803D manufactured by Noritake Co., Ltd.), and that glass substrate was baked at 550° C. after drying it at 120° C., and a black member 3, of which thickness is 5 μm, was formed. Pitches of aperture portions 3*a* were set to become 450 μm in the Y direction and 150 μm in the X direction, which were same as those in device pitches on a rear plate, and the size of the aperture portions 3*a* was set to become 220 μm in the Y direction and 90 μm in the X direction.

Next, the ribs 6 and the feeding resistors 7 will be formed. First, an insulation paste of bismuth oxide series (NP7753 manufactured by Noritake Co., Ltd.) was applied by using a slit coater such that a film thickness after the baking becomes 200 μm and then it was dried at 120° C. for ten minutes.

A high-resistance paste, in which a ruthenium oxide was contained, was formed by a screen printing method such that a film thickness after the baking becomes 10 μm so as to be laminated on this insulation paste and then it was dried at 120° C. for ten minutes. In the present example, although a high-resistance paste layer was printed on a whole surface of an image display area, it is allowed to use a method that the shapes of parts only remained as a final configuration after the sandblasting to be described later are previously pattern printed. When a resistance value was measured after applying the material used in this high-resistance paste layer in test patterns, the volume resistance was about $10^{-1}$ Ω·m.

Figure 7A:
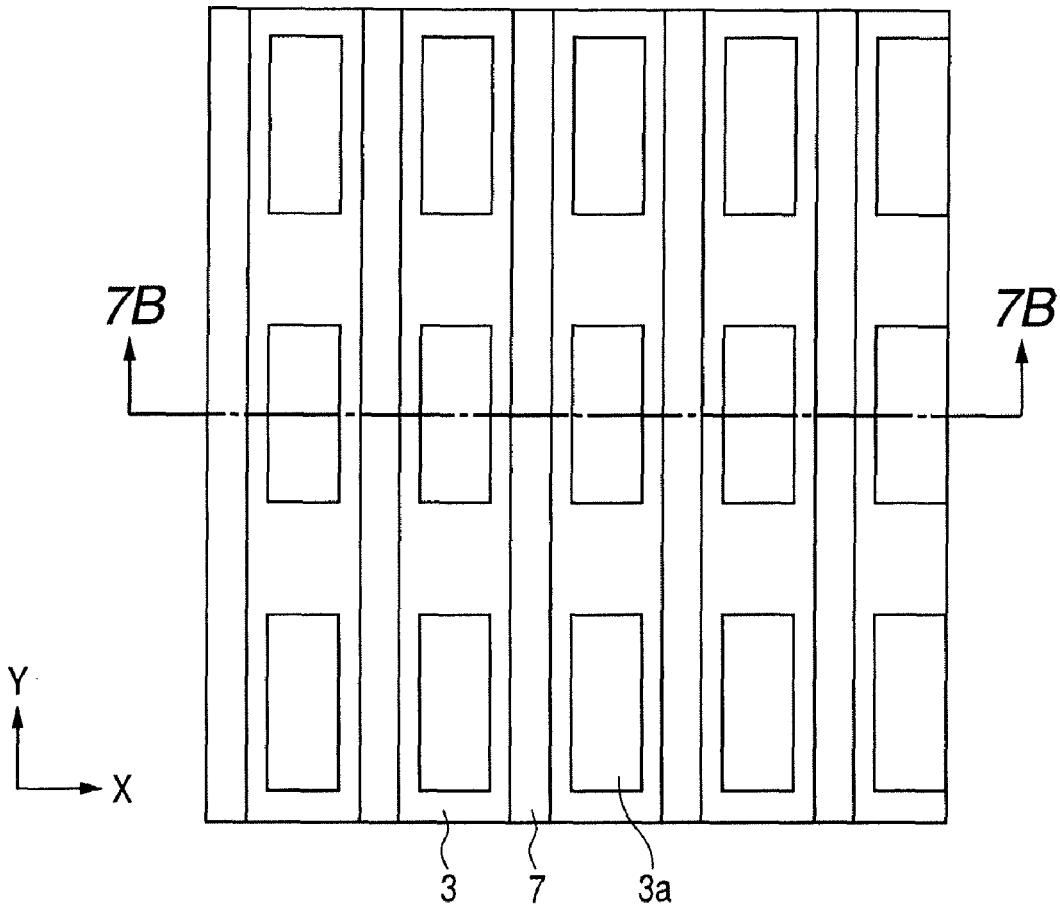
FIGS. 7A and 7B are views illustrating a manufacturing process of the light emitter substrate of the embodiment in the present invention.
Figure 7B:
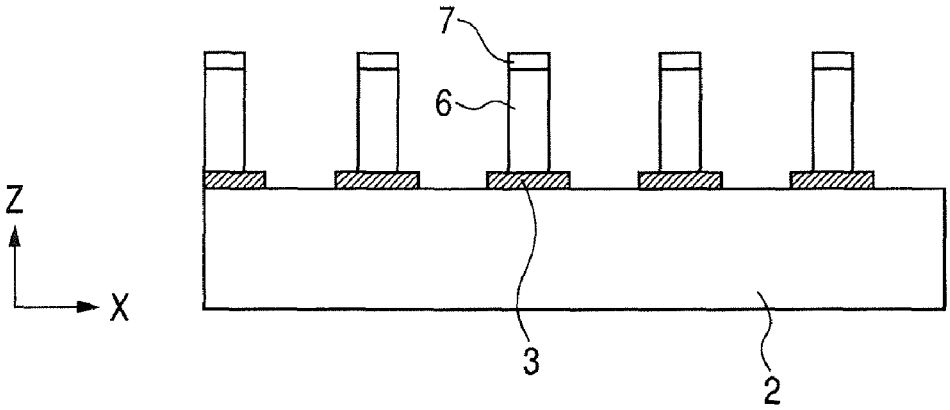

Next, a dry film resist (DFR) is pasted by using a laminator apparatus and the DFR was pattern exposed after aligning a chrome mask for exposure to a predetermined position. The alignment was performed by using a mark for alignment (not illustrated) provided at an external of an image formation area. A pattern to be exposed was set as a stripe shape, of which the width is 50 μm (that is, aperture portion width is 100 μm), in parallel with long sides (extended in the Y direction) of the aperture portions 3*a* of the black member 3 so as to be overlapped with the black member 3. Furthermore, a mask for the sandblasting having apertures on desired positions was formed by executing a showering process for the liquid developer and the rinse liquid of the DFR and executing a drying process. For this constitution, the unnecessary high-resistance paste and insulation paste were eliminated by fitting with the apertures of the DFR by a sand blasting method, where SUS grains were treated as grinding grains, and the DFR was stripped off by the remover liquid shower and a cleaning process was executed, then the ribs 6 and the feeding resistors 7 were formed by performing the baking at 530° C. (FIGS. 7A and 7B).

Next, the phosphors 4 were dropped in the light-emitting areas and printed by a screen printing method by fitting with the structure of the ribs 6 having the apertures by using a paste, in which phosphors P22 used in a technical field of CRT are dispersed. In the present embodiment, the phosphors 4 of three colors R, G and B are color-coded so as to become a color display. The film thickness of each of the phosphors 4 was set to become 15 μm. The phosphors 4 of three colors R, G and B were dried at 120° C. after the printing. The drying may be performed every color or may be collectively performed for the three colors. Additionally, the water solution containing silicate alkali so called a liquid glass acting as a binding agent later was spray applied.

Figure 8A:
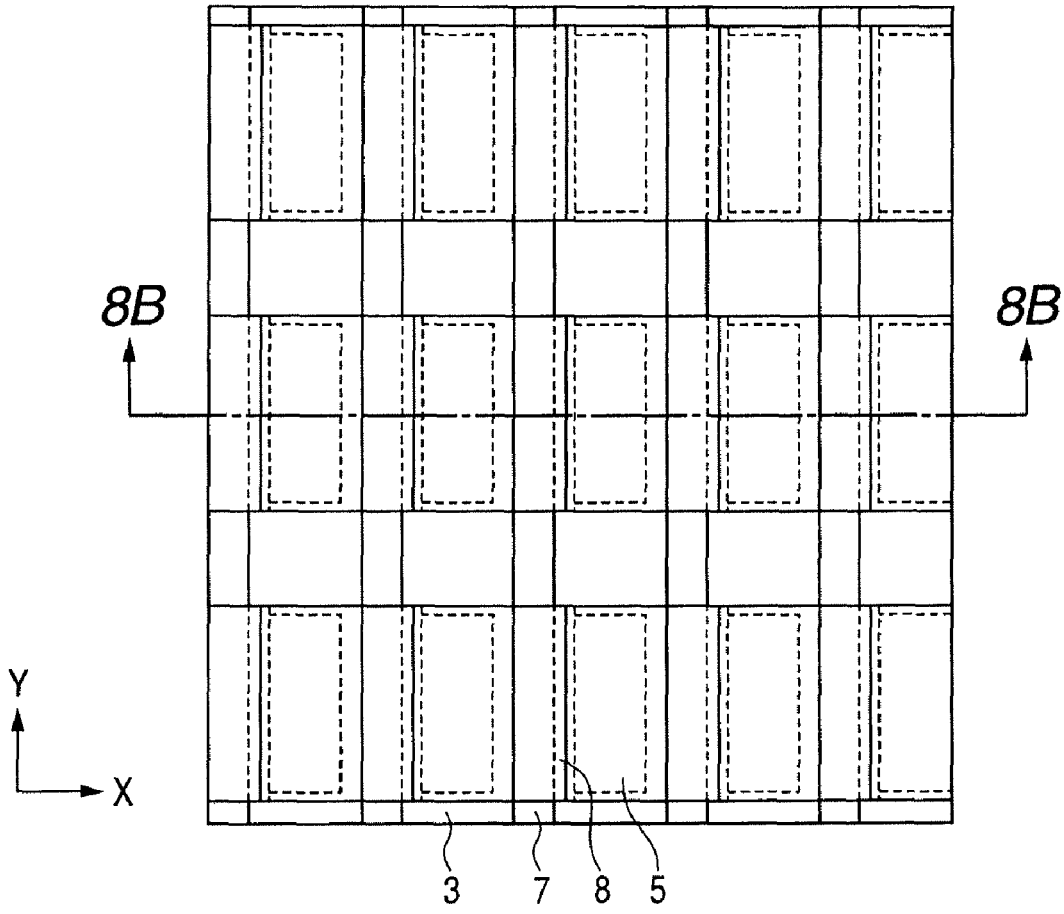
FIGS. 8A and 8B are views illustrating a manufacturing process of the light emitter substrate of the embodiment in the present invention.
Figure 8B:
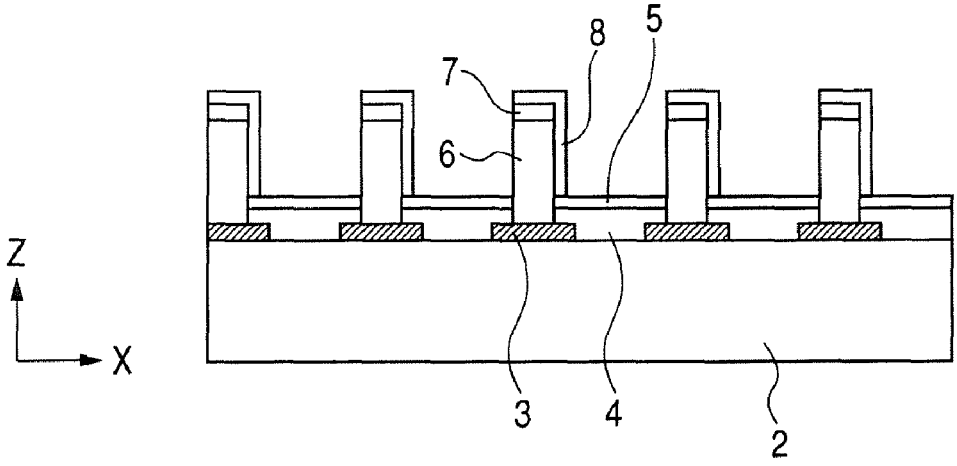

Next, an acrylic emulsion was applied by a spray coating method and dried, and gaps in phosphor powders were infilled by the acrylic resin, and an aluminum film, which becomes to serve as the metal back 5, was vapor deposited. In this case, a metal mask having aperture portions on only the area reaches to the aperture portions 3*a* of the black member 3 and the feeding resistors 7 on the one side of ribs 6 adjacent to the apertures 3*a* is used, and the metal backs 5 and the connecting conductors 8 were simultaneously formed (FIGS. 8A and 8B). The thickness of the aluminum was set to become 100 nm.

Additionally, the paste, of which the volume resistance after the baking is $10^4$ Ω·m, was formed on the feeding resistor 7 by a transfer method as the cover member 9. The cover members 9 were made to cover the whole of the feeding resistors 7 after the baking. And, the connecting conductors 8 are laminated on the area adjacent to the metal backs 5 on the feeding resistors 7, and the cover members 9 were laminated on the connecting conductors 8 in this area.

Finally, the resin contained in the paste was decomposed and eliminated by heating the paste at 500° C. and then baked to be hardened (FIGS. 1A and 1B). The film thickness of the cover members 9 was set to 10 μm.

A high-voltage introduction terminal which passes through the substrate 2 through a through hole is provided on the substrate 2, and the high-voltage introduction terminal is connected at edge portions of the feeding resistor 7 and an image formation area (not illustrated).

The image displaying apparatus illustrated in FIG. 6 was manufactured by using the light emitter substrate manufactured by the above-mentioned process as a face plate. The resistance per one abutting portion of the spacer 20 against the cover member 9 is that the resistance of the spacer 20 is $10^{10}$Ω and the resistance of the cover member is $10^7$Ω.

In the image displaying apparatus constituted as mentioned above, when an image is displayed by applying the voltage of 10 kV to the metal backs 5 through the feeding resistors 7, an excellent image having very little color mixture due to the halation can be displayed.

Also, even if the discharge between the electron-emitting devices and the face plate is induced by compelling to occur the device destruction by applying the excessive voltage to specific electron-emitting devices, the secondary discharge between the adjacent feeding resistors 7 is not observed and the discharge current is sufficiently restricted, and any abnormity was not produced in peripheral devices other than the devices purposely destructed.

Example 2

In the present example, the light emitter substrate exemplified in FIG. 3 was manufactured.

The present example is different from the example 1 in a point that the ribs 6 were formed into a lattice shape of also extending in the X direction. Also, as to the ribs 6 extending in the X direction, the width was set to become 50 μm and the height was set to become 150 μm so as to form to overlap with the black member 3. The high-resistance paste, in which the ruthenium oxide is contained, was previously used for the feeding resistors 7, and a stripe pattern was formed by a screen printing method. Excepting the above-mentioned constitution, the light emitter substrate was similarly manufactured to a case in the example 1.

When an image was displayed by applying the voltage of 10 kV to the metal backs 5 through the feeding resistors 7 by similarly constituting the image displaying apparatus to a case in the example 1 by using the light emitter substrate in the present example as the face plate, an excellent image having very little color mixture due to the halation can be displayed. Furthermore, since the halation in the Y direction can be also suppressed, lines in the X direction can be clearly displayed without the blur as compared with a case in the example 1.

Also, even if the discharge between the electron-emitting devices and the face plate is induced by compelling to occur the device destruction by applying the excessive voltage to specific electron-emitting devices, the secondary discharge between the adjacent feeding resistors 7 is not observed and the discharge current is sufficiently restricted, and any abnormity was not produced in peripheral devices other than the devices purposely destructed.

Example 3

In the present example, the light emitter substrate exemplified in FIGS. 4A and 4B was manufactured.

The present example is different from the example 1 in a point that adjacent two sub-pixels were formed as one anode area. Therefore, the feeding resistor 7 is positioned on the rib 6 existing between sub-pixels within the one anode area, and the metal back 5 within the one anode area was connected by the connecting conductor 8 stepping over the rib 6. A stripe shaped pattern was formed by a screen printing method by using the paste for a high-resistance electrode in which indium tin oxide fine particles were dispersed as the material of the feeding resistors 7. The connecting conductor 8 was formed in a manner that aluminum films were obliquely vapor deposited every the one direction sequentially from the opposite two directions. At this time, a mask, to which the Y-directional stripe serving as a canopy was added, was used such that an aluminum film is not formed on a side surface of the rib 6 on which the feeding resistor 7 is not arranged. Additionally, the cover member 9 was formed by using a transfer method same as that in the example 1, and the cover member 9 was formed also on the rib 6 on which the feeding resistor 7 is not arranged. The film thickness of the cover members 9 was set to become 5 μm on a portion where the feeding resistor 7 is arranged and 10 μm on a portion where the feeding resistor is not arranged.

When an image was displayed by applying the voltage of 10 kV to the metal backs 5 through the feeding resistors 7 by similarly constituting the image displaying apparatus to a case in the example 1 by using the light emitter substrate in the present example as the face plate, an excellent image having very little color mixture due to the halation can be displayed.

Also, even if the discharge between the electron-emitting devices and the face plate is induced by compelling to occur the device destruction by applying the excessive voltage to specific electron-emitting devices, the secondary discharge between the adjacent feeding resistors is not observed and the discharge current is sufficiently restricted, and any abnormity is not produced in peripheral devices other than the devices purposely destructed.

While the present invention has been described with reference to the exemplary embodiments, it is to be understood that the invention is not limited to the disclosed exemplary embodiments. Any modification or variation within the scope of the invention should be possible.

This application claims the benefit of Japanese Patent Application Nos. 2008-206568, filed Aug. 11, 2008, and 2009-164467, filed Jul. 13, 2009, which are hereby incorporated by reference herein in their entirety.

What is claimed is:

1. A light emitter substrate comprising:

a substrate;

plural light-emitting members positioned in a matrix on the substrate;

at least one rib, each positioned at a respective gap between corresponding ones of the light-emitting members and protruding from the substrate as compared with the light-emitting members, wherein each rib has a top surface and side surfaces;

plural conductors arranged in a matrix, each conductor covering at least one of the light-emitting members; and at least one feeding resistor, each positioned on the top surface of a respective rib and configured to electrically connect to at least one of the conductors, and at least one high-resistance cover member, each of which covers a corresponding one of the feeding resistors and which has a resistance higher than that of that feeding resistor.

2. A light emitter substrate according to claim 1, wherein each cover member wholly covers the corresponding one of the feeding resistors.

3. An image displaying apparatus wherein an electron source substrate which is equipped with plural electron-emitting devices and the light emitter substrate which is described in claim 1 are mutually positioned oppositely.

4. An image displaying apparatus according to claim 3, further comprising at least one spacer, each abutting against a corresponding one of the cover members and positioned between the electron source substrate and the light emitter substrate, wherein a resistance of each cover member is lower than a resistance of each spacer.

5. An image displaying apparatus according to claim 4, wherein each cover member is provided also over a portion of the rib on which a feeding resistor is not positioned.

6. A light emitter substrate according to claim 1, wherein each feeding resistor electrically connects corresponding ones of the plural conductors via a connecting conductor arranged on the side surface of a corresponding one of the ribs or, via that corresponding rib, which has conductivity itself.

* * * * *